US007658055B1

(12) United States Patent
Adriani et al.

(10) Patent No.: US 7,658,055 B1
(45) Date of Patent: Feb. 9, 2010

(54) METHOD OF PACKAGING SOLAR MODULES

(75) Inventors: Paul Adriani, Palo Alto, CA (US); Martin Roscheisen, San Francisco, CA (US)

(73) Assignee: Nanosolar, Inc., San Jose, CA (US)

( * ) Notice: Subject to any disclaimer, the term of this patent is extended or adjusted under 35 U.S.C. 154(b) by 572 days.

(21) Appl. No.: 11/537,657

(22) Filed: Oct. 1, 2006

(51) Int. Cl.
*B65B 5/10* (2006.01)
*B65B 23/00* (2006.01)

(52) U.S. Cl. ..... 53/475; 53/447; 136/251

(58) Field of Classification Search ..... 53/447, 53/475; 136/251
See application file for complete search history.

(56) References Cited

U.S. PATENT DOCUMENTS

| | | | | |
|---|---|---|---|---|
| 4,233,085 | A * | 11/1980 | Roderick et al. | 136/251 |
| 4,262,653 | A * | 4/1981 | Holland | 126/400 |
| 4,561,541 | A * | 12/1985 | Lawrence | 206/722 |
| 5,644,899 | A * | 7/1997 | Truesdale | 53/447 |
| 6,427,842 | B1 * | 8/2002 | Green | 53/447 |
| 6,559,371 | B2 * | 5/2003 | Shingleton et al. | 136/251 |
| 6,769,230 | B2 * | 8/2004 | Handa et al. | 53/447 |
| 7,487,771 | B1 * | 2/2009 | Eiffert et al. | 136/251 |
| 2004/0163988 | A1 * | 8/2004 | Yamada et al. | 206/454 |
| 2005/0072121 | A1 * | 4/2005 | Hortzleza et al. | 53/447 |
| 2006/0005875 | A1 * | 1/2006 | Haberlein | 136/251 |
| 2008/0264467 | A1 * | 10/2008 | Doko | 136/245 |

FOREIGN PATENT DOCUMENTS

| | | | |
|---|---|---|---|
| GB | 2003383 | A * | 3/1979 |
| JP | 2000079961 | A * | 3/2000 |
| JP | 2000203684 | A * | 7/2000 |
| JP | 2002164562 | A * | 6/2002 |
| JP | 2002302157 | A * | 10/2002 |
| JP | 2005153888 | A * | 6/2005 |
| JP | 2005231704 | A * | 9/2005 |

OTHER PUBLICATIONS

Machine translation of JP 2002-302157, http://www4.ipdl.inpit.go.jp/Tokujitu/tjsogodbenk.ipdl, retrieved Sep. 4, 2009, 22 pages.*

* cited by examiner

*Primary Examiner*—Stephen F Gerrity

(57) ABSTRACT

Methods and devices are provided for reducing wasted space and capacity in solar module assemblies. In one embodiment, the method comprises mounting a plurality of modules onto at least one support rail to define a solar assembly segment wherein the solar assembly segment has a length of no more than about half the interior length of the shipping container used to ship the segment. The solar modules each have a weight less than about 20 kg and a length between about 1660 mm and about 1666 mm, and a width between about 700 mm and about 706 mm. In one embodiment, the length of the solar modules is limited by the longest support beam that may fit in a shipping container, which in one example is about 11,720 mm. The modules are also limited so that they can be limited to weighing no more than about 20 kg. In one embodiment, the module may be sized to provide at least 80 watts of power at AM 1.5 G. In another embodiment, the module may be sized to provide at least 90 watts of power at AM 1.5 G. In another embodiment, the module may be sized to provide at least 100 watts of power at AM 1.5 G. In another embodiment, the module may be sized to provide at least 110 watts of power at AM 1.5 G.

14 Claims, 8 Drawing Sheets

METHOD OF PACKAGING SOLAR MODULES

FIELD OF THE INVENTION

This invention relates generally to photovoltaic devices, and more specifically, to solar cells and/or solar cell modules designed for ease of shipping and installation.

BACKGROUND OF THE INVENTION

Solar cells and solar cell modules convert sunlight into electricity. Traditional solar cell modules are typically comprised of polycrystalline and/or monocrystalline silicon solar cells mounted on a support with a rigid glass top layer to provide environmental and structural protection to the underlying silicon based cells. This package is then typically mounted in a rigid aluminum or metal frame that supports the glass and provides attachment points for securing the solar module to the installation site. A host of other materials are also included to make the solar module functional. This may include junction boxes, bypass diodes, sealants, and/or multi-contact connectors used to complete the module and allow for electrical connection to other solar modules and/or electrical devices. Certainly, the use of traditional silicon solar cells with conventional module packaging is a safe, conservative choice based on well understood technology.

Drawbacks associated with traditional solar module package designs, however, have limited the ability to install large numbers of solar panels in a cost-effective manner. This is particularly true for large scale deployments where it is desirable to have large numbers of solar modules setup in a defined, dedicated area. Traditional solar module packaging comes with a great deal of redundancy and excess equipment cost. For example, a recent installation of conventional solar modules in Pocking, Germany deployed 57,912 monocrystalline and polycrystalline-based solar modules. This meant that there were also 57,912 junction boxes, 57,912 aluminum frames, untold meters of cablings, and numerous other components. These traditional module designs inherit a large number of legacy parts that hamper the ability of installers to rapidly and cost-efficiently deploy solar modules at a large scale.

Traditional solar cell modules are also limited in the size of their cells and accordingly have limits on the size of their modules. For example, traditional silicon solar cells are limited by the raw silicon ingots used for those cells. The current sizes are limited to 100 mm, 125 mm, 150 mm, and 200 mm sized cells. These limits of the cells also introduces limits to the size of modules available. The limits on module size results in wasted space in the shipping containers used to transport these modules and solar assemblies to installation sites. Limited module sizes limit the amount of product that a manufacturer can efficiently transport to an installation site. Due to the suboptimal sizing of these traditional module packages, wasted space and capacity is introduced along the entire manufacturing, delivery, and installation process.

Although subsidies and incentives have created some large solar-based electric power installations, the potential for greater numbers of these large solar-based electric power installations has not been fully realized. There remains substantial improvement that can be made to photovoltaic cells and photovoltaic modules that can greatly improve their ease of installation, maximize the capacity delivered, and create much greater market penetration and commercial adoption of such products, particularly for large scale installations.

SUMMARY OF THE INVENTION

Embodiments of the present invention address at least some of the drawbacks set forth above. It should be understood that at least some embodiments of the present invention may be applicable to any type of solar cell, whether they are rigid or flexible in nature or the type of material used in the absorber layer. Embodiments of the present invention may be adaptable for roll-to-roll and/or batch manufacturing processes. At least some of these and other objectives described herein will be met by various embodiments of the present invention.

In one embodiment of the present invention, a method is provided for reducing wasted space and capacity in solar module assemblies. The method comprises mounting a plurality of modules onto at least one support rail to define a solar assembly segment wherein the solar assembly segment has a length of no more than about half the interior length of the shipping container used to ship the segment. The solar modules each have a weight less than about 20 kg and a length between about 1660 mm and about 1666 mm, and a width between about 700 mm and about 706 mm. In one embodiment, the length of the solar modules is limited by the longest support beam that may fit in a shipping container, which in one example is about 11,720 mm.

Optionally, the following may also be adapted for use with any of the embodiments disclosed herein. The modules may be configured so that they are limited to weighing no more than about 20 kg. Optionally, the modules may be configured so that they are limited to weighing no more than about 18 kg. In one embodiment, the module may be sized to provide at least about 80 watts of power at AM 1.5 G. In another embodiment, the module may be sized to provide at least about 90 watts of power at AM 1.5 G. In another embodiment, the module may be sized to provide at least about 100 watts of power at AM 1.5 G. In another embodiment, the module may be sized to provide at least about 110 watts of power at AM 1.5 G.

In another embodiment of the present invention, a method for shipping the modules comprises providing an elongate shipping container having an interior length, an interior width, and an interior height, wherein the interior length is the longest dimension. The method comprises mounting a plurality of modules onto at least one support rail to define a solar assembly segment. A plurality of solar assembly segments are placed into the shipping container, wherein the solar assembly segment has a length of no more than about half the interior length of the shipping container. The modules may each have a weight less than about 20 kg and a length of no more than about 1666 mm, and a width of no more than about 706 mm.

Optionally, the following may also be adapted for use with any of the embodiments disclosed herein. In one embodiment, the shipping container has an interior length of at least about 11,820 mm. In another embodiment, the shipping container has an interior length of no more than about 12,060 mm. The long dimension of the module may be configured so that seven of the modules together in length substantially matches a beam of a length that fits in the container. Each solar module includes 96 solar cells. Optionally, each solar module includes 48 solar cells. Each module may provide at least 100 W of power at AM1.5 G exposure. Optionally, each module provides at least about 5 amp of current and/or at least about 21 volts of voltage at AM1.5 G exposure. Solar cells in the module may be thin-film solar cells. Solar cells in the module may be based on a metal substrate. The substrate may be an elongate planar member that can be wound and unwound from a rolled configuration. The beam may have a length of about 11,720 mm. The modules may be glass-glass modules having a glass top sheet and a glass bottom sheet. Optionally, the modules may be glass-glass modules having a top sheet of solar glass and a bottom sheet of tempered glass.

In yet another embodiment of the present invention, a solar assembly segment is provided that is sized to be housed in a container. The segment may be comprised of a plurality of solar modules and at least one support rail. The support rail couples the solar modules together, wherein the modules have a support length sized so that seven of the modules together in length substantially matches a beam of a length that fits in the container.

In yet another embodiment of the present invention, a solar module is provided comprising at least one solar glass top sheet, at least one layer of encapsulant, a plurality of solar cells, and at least one glass bottom sheet. The layer of encapsulant and the plurality of solar cells may be sandwiched between the solar glass top sheet and the glass bottom sheet. The ratio of width to length for the module is about 700:1660. In another embodiment, the ratio is between about 700:1660 to about 706:1660. Optionally, the ratio is between about 700:1667 to about 706:1667

In a still further embodiment of the present invention, a solar module installation comprises a ground installation support comprised of a plurality of beams each having a length between about 11500 mm and about 12100 mm. The installation may include a plurality of solar assembly segments, wherein each of the solar assembly segments comprises of at least seven solar modules, wherein a combined length of the modules is substantially equivalent to the length of the beam, wherein the beam has a length substantially equivalent to the interior length of the container.

A further understanding of the nature and advantages of the invention will become apparent by reference to the remaining portions of the specification and drawings.

DESCRIPTION OF THE SPECIFIC EMBODIMENTS

It is to be understood that both the foregoing general description and the following detailed description are exemplary and explanatory only and are not restrictive of the invention, as claimed. It may be noted that, as used in the specification and the appended claims, the singular forms "a", "an" and "the" include plural referents unless the context clearly dictates otherwise. Thus, for example, reference to "a material" may include mixtures of materials, reference to "a compound" may include multiple compounds, and the like. References cited herein are hereby incorporated by reference in their entirety, except to the extent that they conflict with teachings explicitly set forth in this specification.

In this specification and in the claims which follow, reference will be made to a number of terms which shall be defined to have the following meanings:

"Optional" or "optionally" means that the subsequently described circumstance may or may not occur, so that the description includes instances where the circumstance occurs and instances where it does not. For example, if a device optionally contains a feature for an anti-reflective film, this means that the anti-reflective film feature may or may not be present, and, thus, the description includes both structures wherein a device possesses the anti-reflective film feature and structures wherein the anti-reflective film feature is not present.

Photovoltaic Assembly

Figure 1:
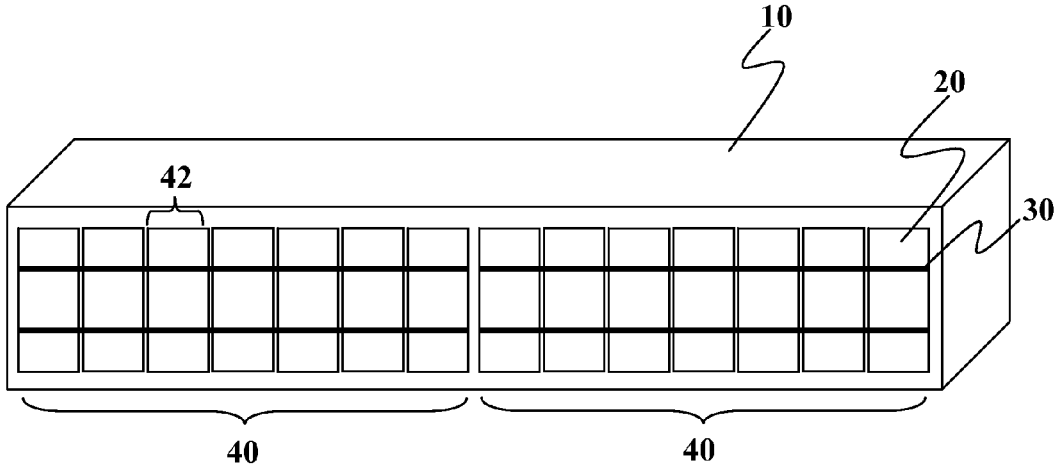
FIG. 1 is a perspective view of a container containing a plurality of solar assembly segments according to one embodiment of the present invention.

Referring now to FIG. 1, one embodiment of the present invention will now be described. FIG. 1 shows a shipping container 10 sized to hold a plurality of solar modules 20 that are coupled to support rails 30. The shipping container 10 may be a standard sized waterborne and/or landborne shipping container. In one embodiment, the interior length of the container 10 is about 11,820 mm for a 40 foot flat rack container. In another embodiment, the interior length of the container 10 is between about 12,043 to about 12,056 mm for high cube, dry freight, or open top containers. The interior width may be between about 2148 mm to about 2347 mm. The height may be in the range of about 2690 mm to about 2095 mm.

As the modules of the present invention may be designed for large-scale installations, many features and sizes may be selected to maximize the number of modules that can be delivered within the shipping container 10, while meeting certain constraints. Although not limited to the following, in one embodiment of the present invention, the size of the modules 20 is optimized to allow the most number of modules to be included in the container 10 while also taking into consideration the weight of each module, the wind load that can be sustained, and other factors. Due to the inflexible sizing of known silicon based solar cells, traditional solar modules have been unable to be designed to meet these constraints.

Figure 13:
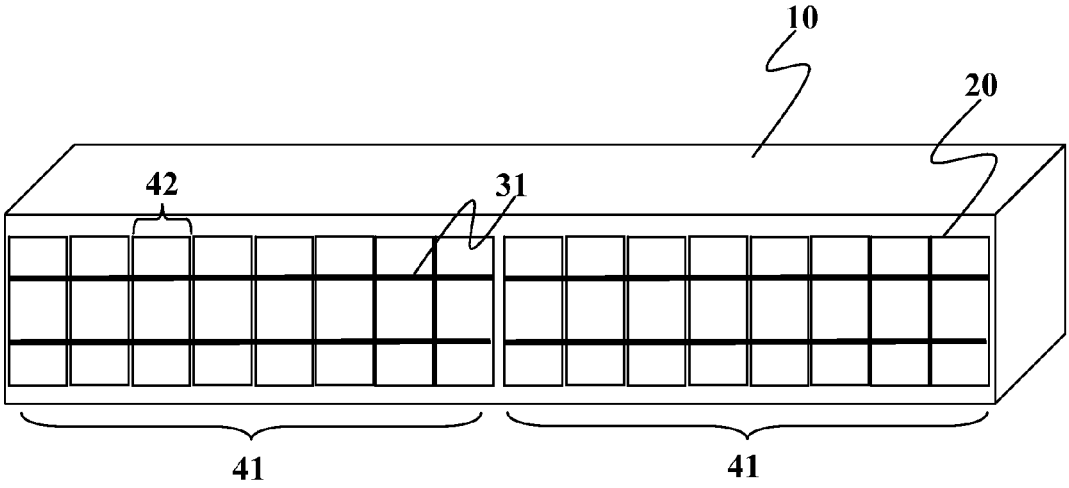
FIG. 13 is a perspective view of a container containing a plurality of solar assembly segments according to one embodiment of the present invention.

As seen in the embodiment of FIG. 1, the modules 20 may be mounted by 4 point clips (not shown for ease of illustration) onto the support rails 30 to form a segment 40 of the solar assembly. As will be discussed later, mounting the modules 20 onto the support rail 30 eliminates installation costs and facilitates on-site installation of the modules. Each container 10 may hold at least two sets of the segment 40, and module sizes are configured so that containers 10 deliver the most number of cells while meeting various constraints. In the present embodiment, each module 20 has a width 42 of about 700 mm, with a total of seven modules per segment 40. That makes for 4900 mm in module length and accounting for spacing between modules 20, the length of each segment 40 is about 5000 mm. If two segments 40 are included, a total of about 10,000 mm is used within each container 10 length-wise. In yet another embodiment, an eight module version example of the already existing seven module example would also be useful and valid. As seen in FIG. 13, the eight module segment 41 would be on a beam 31 of about 5750 mm, just as the seven module version is on a 5000 mm beam. This eight module segment 41 would still fit in half a shipping container (wherein the total length of two beams end-to-end is 2*5750=11500<11720 mm). Of course, more than two segments 40 or 41 may be included in each container 10 as a whole, but length-wise, the number of segments 40 or 41 that can be aligned in that orientation in the container 10 is limited to two. Containers may have only one size of segment or may have combinations of different sized segments (i.e. 40 and 41).

Figure 2:
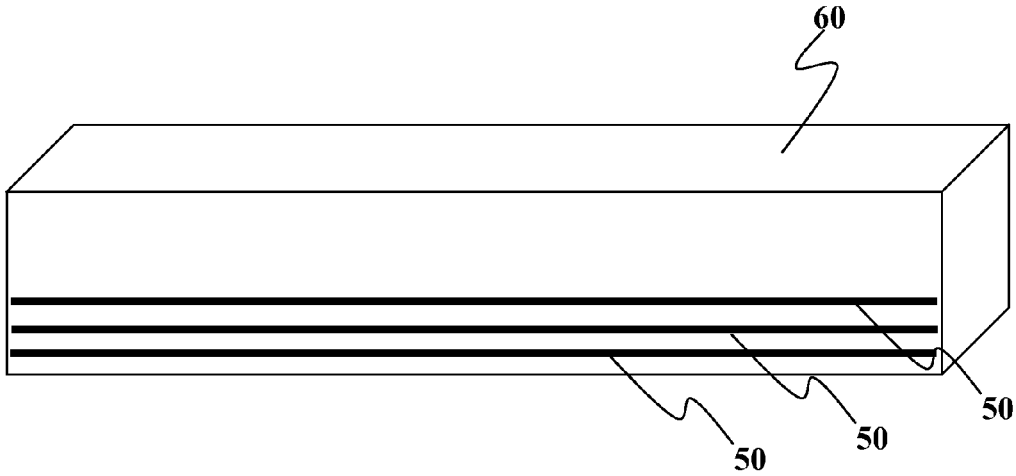
FIG. 2 is a perspective view a container containing a plurality of support beams according to one embodiment of the present invention.

Referring now to FIG. 2, a first constraint associated with the present invention involves the length of beams 50 that will support the solar assembly segments 40 on the ground installation. As seen in FIG. 2, these beams 50 are also sized to be shipped in containers 60 that are of the same size as that of container 10. This allows the same containers to be used without having to customize shipping containers used to ship materials to the installation site. Providing some tolerance for beam length, the beams 50 are about 11,720 mm long and the containers have interior dimensions of about 11820 mm in length. This provides for about 50 mm of beam-to-wall handling spacing within each container 60. Of course, some embodiments may provide for more beam-to-wall clearance (up to 200 mm at each end), while other have less than 50 mm of clearance. As will be more clearly illustrated in FIGS. 3-5, the length of the beam 50 determines part of the sizing of the modules 20.

Figures 3, 4:
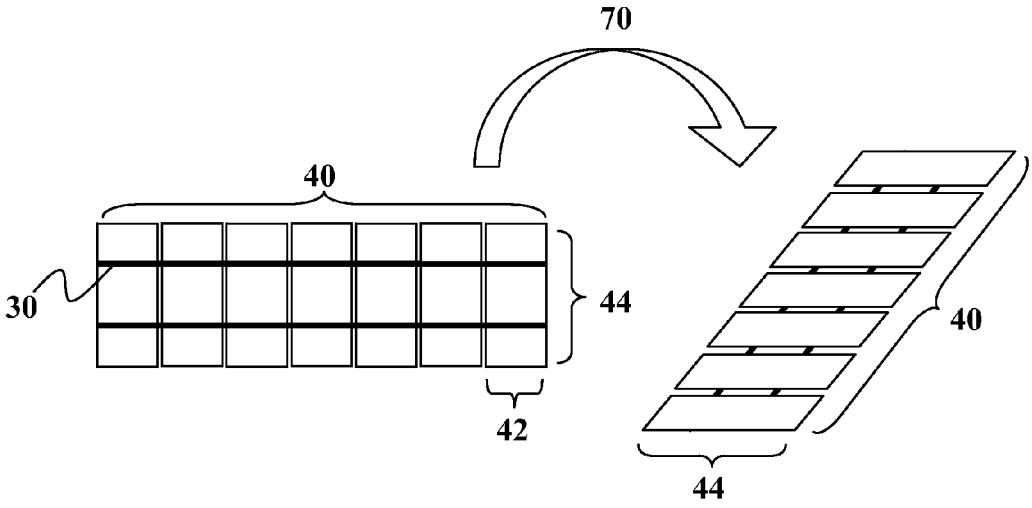
FIGS. 3 and 4 shows various orientations of a solar assembly segment according to embodiments of the present invention.

Referring now to FIG. 3, the segment 40 is removed from the container 10 in a horizontal orientation. The segments 40 contain modules 20 that have a width 42 of about 700 mm and a length 44 of about 1660 mm. The length of 1660 mm is selected to maximize the number of segments 40 that can be mounted onto the beam 50. This will become more clear with reference to the following figures.

Figure 5:
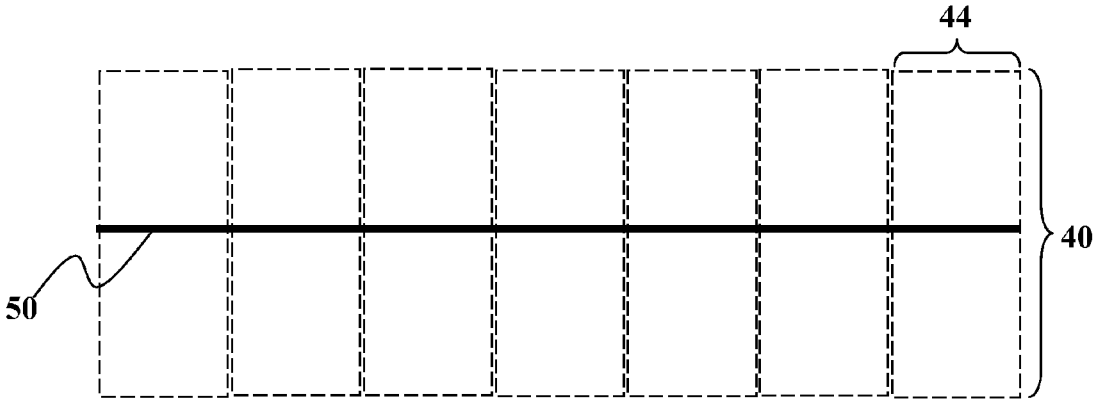
FIG. 5 shows spacing of a plurality of solar assembly segments on a support beam according to one embodiment of the present invention.
Figure 6:
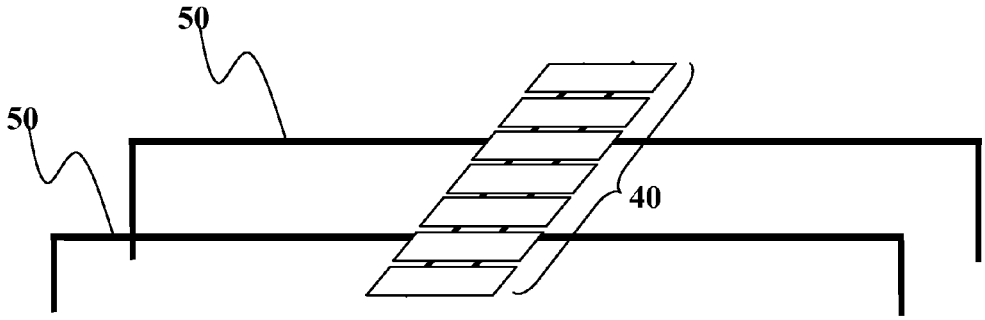
FIGS. 6 through 8 show a plurality of solar assembly segments on support beams according to embodiments of the present invention.

Referring now to FIG. 4, once a segment 40 is removed from container 10, it is oriented more vertically as indicated by arrow 70 for mounting onto the beams 50 at the installation site (see also FIGS. 5 and 6). The rotation as indicated by arrow 70 of the segment 40 also rotates the support rails 30 to be on the underside of the modules 20 so as not to obstruct any sun exposure of the photovoltaics. The length of the rail 30 may in the range of about 5000 mm to about 5860 mm in one embodiment, in the range of about 5000 mm to about 5200 mm in another embodiment, and about 5000 mm to about 5100 mm in a still further embodiment. In an eight module embodiment, the length of the rail 30 may in the range of about 5600 mm to 5860 mm. Once oriented as such, the segment 40 may be more easily mounted onto the ground support beams 50.

Referring now to FIG. 5, this change in orientation of the segments 40 shows that the width 44 of the module determines how many segments 40 can be mounted on each of the beams 50. The present embodiment shows that seven segments 40 may be mounted onto each beam 50, wherein the beam 50 is of a length of 11,720 mm. Thus, the length of beam 50 determines the width of the modules. The maximum length of the beam 50 is in turn constrained by the interior length of the container 10.

A second constraint associated with the present embodiment involves the weight of each module 20. Certainly, it would possible in some embodiments to simply make a large area module that has a length of 11,720 mm, instead of using multiple solar modules. The size of each module 20 also has an upper limit, however, which is based on the weight that a typical person can lift to mount the modules onto the rail, either on-site or at the factory. There are numerous situations during manufacturing, assembly, and/or installation where it is desirable to have a module light enough to be handled by a single person. Hence, manufacturing multiple smaller modules is one method to address this issue.

FIG. 6 shows how the segments 40 may be mounted onto two of the beams 50 that are angled above the ground. The beams 50 contact the support rails 30 and are secured thereto to hold the segments 40 in place. The beams 50 may be configured to angle the segments 40, relative to the ground. This angled configuration facilitates runoff from rain or snow. It may also facilitate cooling of the modules and angles the modules to maximize sun exposure. The minimum of the installed system cost arises near 5000 mm rail length. For much shorter lengths, there is too little solar energy capture area per unit length of the main rail support structure, which multiplies the number of number main rail support structures faster than the cost savings of lighter weight main rail support structures. For much longer lengths, the average structure height above the ground is the factor that dominates the cost, where extra height increases wind loads, torques, and support-structure-mass at a rate faster than the increased value of having more solar energy capture area per unit length of the main rail support structure. The balance point between these cost considerations turns out to be near 5000 mm rail length, in the range of about 4000 mm to about 6000 mm rail length when using conventional ground-based solar installation materials and methods well known to those skilled in the art.

Figure 7:
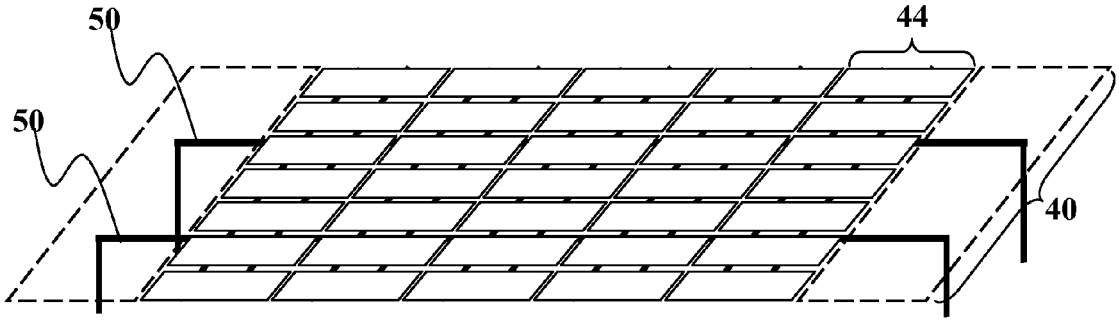

FIG. 7 shows how the beams 50 can support up to seven of the segments 40. Some of the segments 40 are shown in phantom to more easily show the beams 50 underneath. It should be understood that in some embodiments, the ends of the beams 50 may extend only to the last rail 30 on the end segments 40. In still other embodiments, the rails 30 run to the outer edge of the module 20 on the end segments 40.

Figure 8:
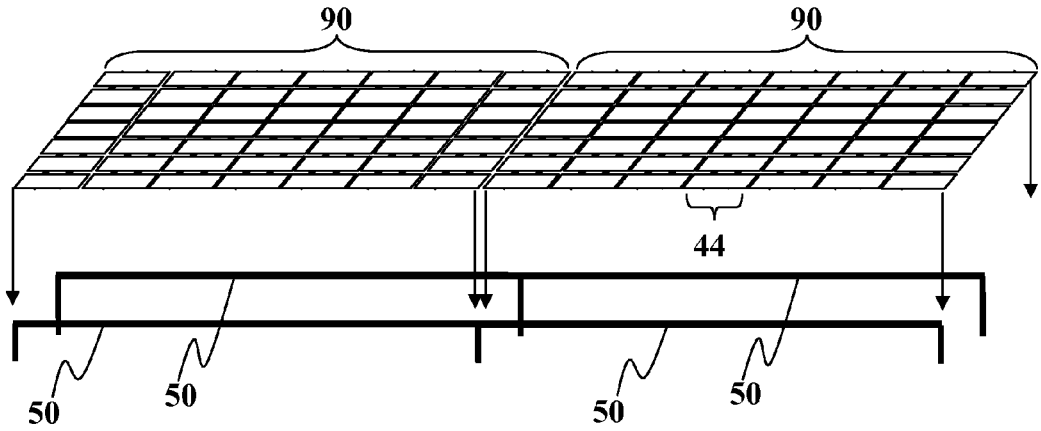

FIG. 8 shows that, in some embodiments, the beams 50 may be connected together end-to-end to form even longer beams. This allows multiple sets 90 of seven segments 40 to be mounted on the beams 50. This can continue for a length as desired based on the size of the installation. In this configuration, the modules 20 have a length 44 selected so that the seven modules have a length that does not exceed the length of the beam 50. This minimizes any over lap of modules over the joint connecting on beam 50 to the end of the next beam 50.

Figure 9:
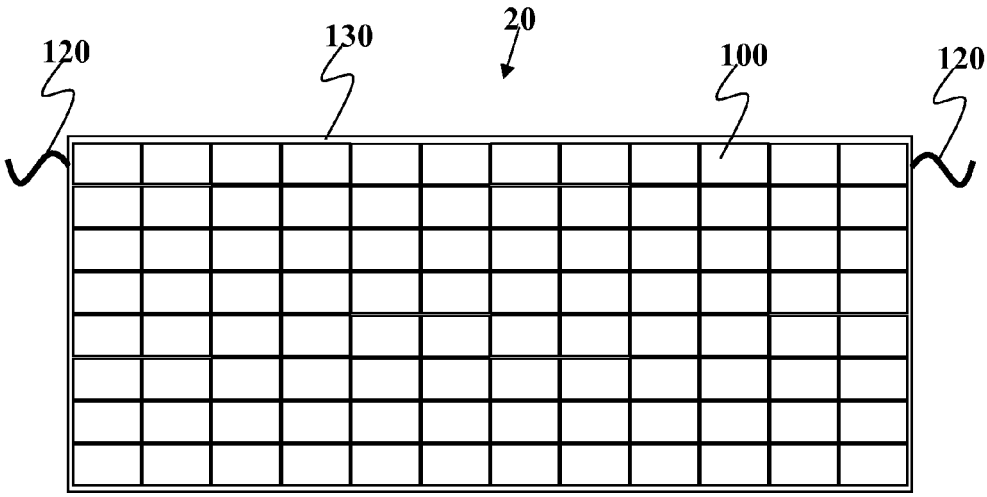
FIGS. 9 and 10 show embodiments of modules according to embodiments of the present invention.

Referring now to FIG. 9, embodiments of the modules 20 used with the above assemblies will be described in further detail. FIG. 9 shows one embodiment of the module 20 with a plurality of solar cells 100 mounted therein. In one embodiment, the cells 100 are serially mounted inside the module packaging. In other embodiments, strings of cells may be connected in series connections with other cells in that string, while string-to-string connections may be in parallel. FIG. 9 shows an embodiment of module 20 with 96 solar cells 100 mounted therein. The solar cells 100 may be of various sizes. In this present embodiment, the cells 100 are about 135.0 mm by about 81.8 mm. As for the module itself, the outer dimensions may range from about 1660 mm to about 1666 by about 700 mm to about 706 mm.

Figure 10:
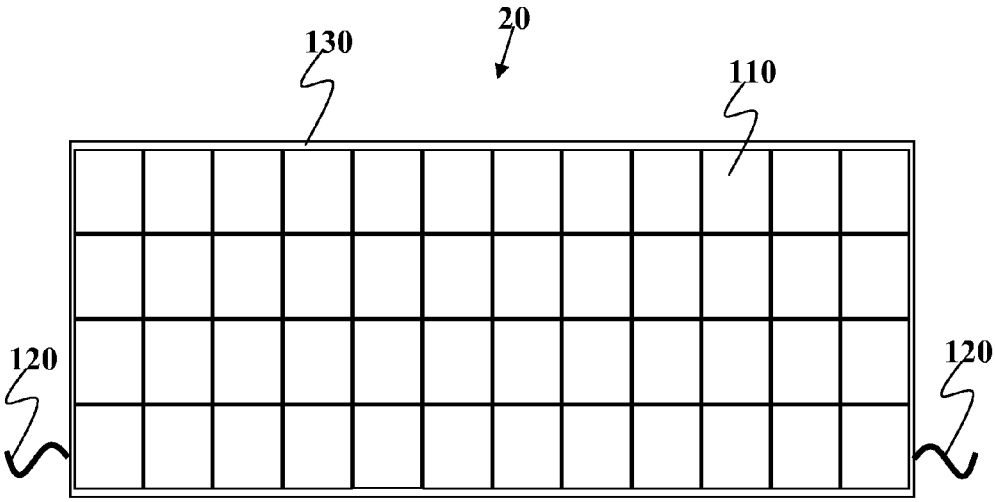

FIG. 10 shows yet another embodiment of module 20 wherein a plurality of solar cells 110 are mounted there. Again, the cells 110 may all be serially coupled inside the module packaging. Alternatively, strings of cells may be connected in series connections with other cells in that string, while string-to-string connections may be in parallel. FIG. 9 shows an embodiment of module 20 with 48 solar cells 110 mounted therein. The cells 110 in the module 20 are of larger dimensions. Having fewer cells of larger dimension may reduce the amount of space used in the module 20 that would otherwise be allocated for spacing between solar cells. The cells 110 in the present embodiment has dimensions of about 135.0 mm by about 164.0 mm. Again for the module itself, the outer dimensions may range from about 1660 mm to about 1666 by about 700 mm to about 706 mm.

The ability of the cells 100 and 110 to be sized to fit into the modules 20 is in part due to the ability to customize the sizes of the cells. In one embodiment, the cells in the present invention may be non-silicon based cells such as but not limited to thin-film solar cells that may be sized as desired while still providing a certain total output. For example, the module 20 of the present size may still provide at least 100 W of power at AM1.5 G exposure. Optionally, the module 20 may also provide at least 5 amp of current and at least 21 volts of voltage at AM1.5 G exposure. Details of some suitable cells can be found in U.S. patent application Ser. No. 11/362,266 filed Feb. 23, 2006, and Ser. No. 11/207,157 filed Aug. 16, 2005, both of which are fully incorporated herein by reference for all purposes. In one embodiment, cells 110 weigh less than 14 grams and cells 100 weigh less than 7 grams. Total module weight may be less than about 18 kg.

Although not limited to the following, the modules of FIGS. 9 and/or 10 may also include other features besides the variations in cell size. For example, the modules may be configured for a landscape orientation and may have connectors 120 that extend from two separate exit locations, each of the locations located near the edge of each module. Optionally, each of the modules 20 may also include a border 130 around all of the cells to provide spacing for weatherproof striping.

Figure 11:
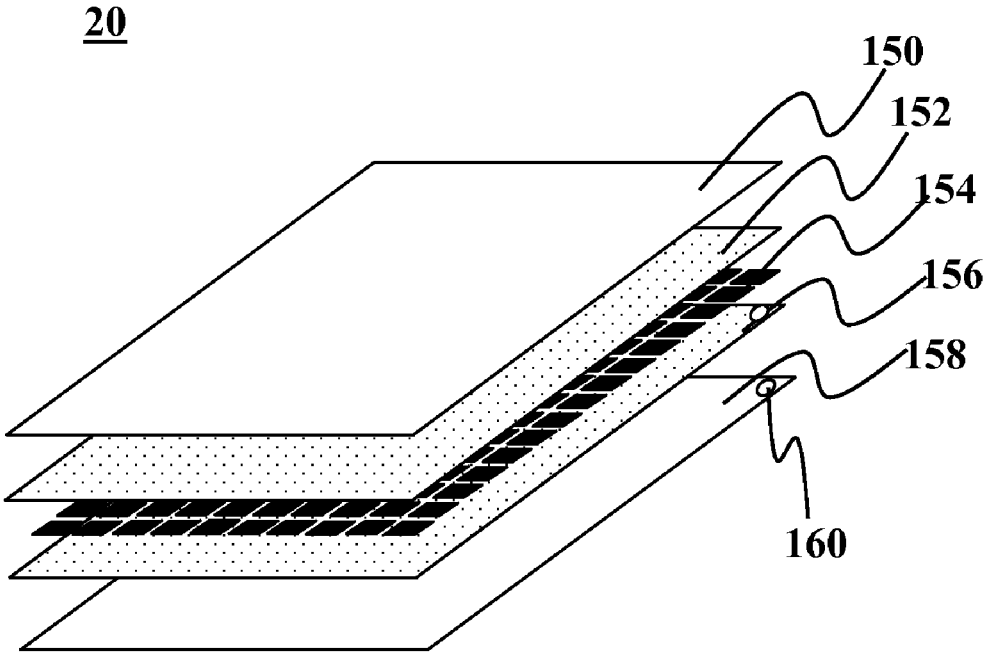
FIG. 11 shows an exploded perspective view of a module according to one embodiment of the present invention.

Referring now to FIG. 11, it should also be understood that the present embodiment may involve glass-glass modules. FIG. 11 shows that the module may include an upper glass layer 150, a layer of pottant 152, a layer 154 of solar cells, an optional second pottant layer 156, and a bottom glass layer 158. Openings 160 may optionally be included in the bottom glass layer 158 to allow for electrical connectors 120 to exit from the backside if the electrical connectors 120 do not exit from between the layers of material. In other embodiments, the solar module may have other configuration such as that shown in U.S. patent application Ser. No. 11/465,787 filed Aug. 18, 2006 and fully incorporated herein by reference for all purposes.

Figure 12:
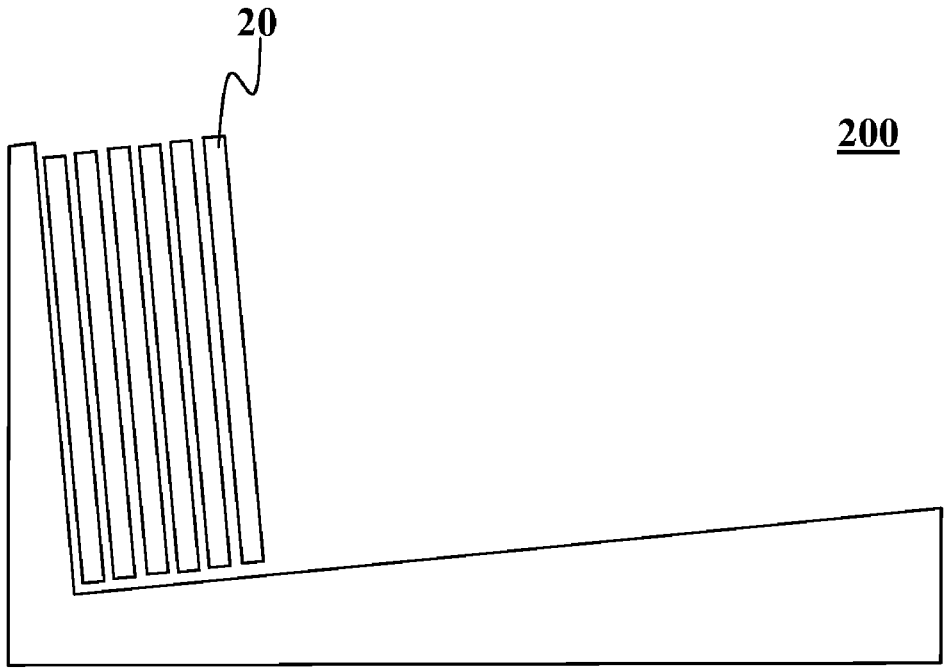
FIG. 12 shows a side-view of a container holding a plurality of modules according to one embodiment of the present invention.

FIG. 12 shows a still further embodiment of a container 200 wherein the modules 20 are shipped to the installation site without being mounted on rails or if they are being shipped to the system integrator for connecting modules to the supports rails 30. As seen in FIG. 12, because the modules 20 may be free of a junction box, the modules 20 may be stacked flat against one another, for tighter packing. Optionally, some padding may be included between modules, but they are significantly thinner than a junction box, which may be 1 or more inches thick. The modules 20 may be packed at an angle to minimize the risk that the modules will topple over during transport or storage.

While the invention has been described and illustrated with reference to certain particular embodiments thereof, those skilled in the art will appreciate that various adaptations, changes, modifications, substitutions, deletions, or additions of procedures and protocols may be made without departing from the spirit and scope of the invention. For example, with any of the above embodiments, the number of cells can be varied in size and shape as desired to provide the required output or to meet certain constraints. As seen in FIG. 13, the number of modules per rail may also be varied, so long as the resulting segment can fit inside the container 10. Some embodiments, may only use a single, very long segment that is substantially the same length as the interior length of the container 10.

Furthermore, those of skill in the art will recognize that any of the embodiments of the present invention can be applied to almost any type of solar cell material and/or architecture. For example, the absorber layer in the solar cell may be an absorber layer comprised of silicon, amorphous silicon, organic oligomers or polymers (for organic solar cells), bilayers or interpenetrating layers or inorganic and organic materials (for hybrid organic/inorganic solar cells), dye-sensitized titania nanoparticles in a liquid or gel-based electrolyte (for Graetzel cells in which an optically transparent film comprised of titanium dioxide particles a few nanometers in size is coated with a monolayer of charge transfer dye to sensitize the film for light harvesting), copper-indium-gallium-selenium (for CIGS solar cells), CdSe, CdTe, Cu(In,Ga)$(S,Se)_2$, Cu(In,Ga,Al)$(S,Se,Te)_2$, and/or combinations of the above, where the active materials are present in any of several forms including but not limited to bulk materials, microparticles, nano-particles, or quantum dots. The CIGS cells may be formed by vacuum or non-vacuum processes. The processes may be one stage, two stage, or multi-stage CIGS processing techniques. Additionally, other possible absorber layers may be based on amorphous silicon (doped or undoped), a nanostructured layer having an inorganic porous semiconductor template with pores filled by an organic semiconductor material (see e.g., US Patent Application Publication US 2005-0121068 A1, which is incorporated herein by reference), a polymer/blend cell architecture, organic dyes, and/or $C_{60}$ molecules, and/or other small molecules, microcrystalline silicon cell architecture, randomly placed nanorods and/or tetrapods of inorganic materials dispersed in an organic matrix, quantum dot-based cells, or combinations of the above. Many of these types of cells can be fabricated on flexible substrates.

Additionally, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a thickness range of about 1 nm to about 200 nm should be interpreted to include not only the explicitly recited limits of about 1 nm and about 200 nm, but also to include individual sizes such as but not limited to 2 nm, 3 nm, 4 nm, and sub-ranges such as 10 nm to 50 nm, 20 nm to 100 nm, etc. . . .

The publications discussed or cited herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed. All publications mentioned herein are incorporated herein by reference to disclose and describe the structures and/or methods in connection with which the publications are cited.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature, whether preferred or not, may be combined with any other feature, whether preferred or not. In the claims that follow, the indefinite article "A" or "An" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. A method of packaging solar modules comprising:

providing an elongate shipping container having an interior length, an interior width, and an interior height, wherein the interior length is the longest dimension;

making a solar assembly segment by mounting a plurality of solar modules onto at least one support rail;

making a plurality of said solar assembly segments; and placing said plurality of solar assembly segments into the shipping container, wherein each of the plurality of solar assembly segments has a length of no more than about half the interior length of the shipping container;

wherein the solar modules each have a weight of less than about 20 kg and a length of no more than about 1666 mm, and a width of no more than about 706 mm.

2. The method of claim 1 wherein the shipping container has an interior length of at least about 11,820 mm.

3. The method of claim 1 wherein the shipping container has an interior length of no more than about 12,060 mm.

4. The method of claim 1 wherein each solar assembly segment comprises seven of the solar modules.

5. The method of claim 4 wherein each of the solar assembly segments has a length of about 5000 mm.

6. The method of claim 1 wherein each solar module includes 96 solar cells.

7. The method of claim 1 wherein each solar module includes 48 solar cells.

8. The method of claim 1 wherein each solar module provides at least 100 W of power at AM 1.5 G exposure.

9. The method of claim 1 wherein each solar module provides at least about 5 amp of current and at least about 21 volts of voltage at AM 1.5 G exposure.

10. The method of claim 1 wherein each of the solar modules comprises thin-film solar cells.

11. The method of claim 1 wherein each of the solar modules comprises solar cells based on a metal substrate.

12. The method of claim 11 wherein the substrate is an elongate planar member that can be wound and unwound from a rolled configuration.

13. The method of claim 1 wherein each of the solar modules are glass-glass modules having a glass top sheet and a glass bottom sheet.

14. The method of claim 1 wherein each of the solar modules are glass-glass modules having a top sheet of solar glass and a bottom sheet of tempered glass.

* * * * *

UNITED STATES PATENT AND TRADEMARK OFFICE

CERTIFICATE OF CORRECTION

PATENT NO. : 7,658,055 B1
APPLICATION NO. : 11/537657
DATED : February 9, 2010
INVENTOR(S) : Adriani et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 703 days.

Signed and Sealed this

Twenty-eighth Day of December, 2010

David J. Kappos

David J. Kappos
*Director of the United States Patent and Trademark Office*